US008429795B2

(12) United States Patent
Huachun

(10) Patent No.: US 8,429,795 B2
(45) Date of Patent: Apr. 30, 2013

(54) TRIPLE-TOOTH WELD-ON HINGE

(76) Inventor: Liang Huachun, Bazhou (CN)

( * ) Notice: Subject to any disclaimer, the term of this patent is extended or adjusted under 35 U.S.C. 154(b) by 0 days.

(21) Appl. No.: 13/174,512

(22) Filed: Jun. 30, 2011

(65) Prior Publication Data

US 2012/0017395 A1 Jan. 26, 2012

(51) Int. Cl.
*E05D 11/10* (2006.01)

(52) U.S. Cl.
USPC ..... 16/321; 16/324; 16/326

(58) Field of Classification Search ..... 16/321, 16/324, 325, 333, 352, 286; 297/354.1, 361.1, 297/366, 367 R, 369, 367 P, 370, 378.12, 297/372, 373
See application file for complete search history.

(56) References Cited

U.S. PATENT DOCUMENTS 2,001,507 A * 5/1935 Stribling ..... 217/60 E
3,643,292 A * 2/1972 Mayer ..... 16/325
4,218,092 A * 8/1980 Schach et al. ..... 297/367 R
4,621,864 A * 11/1986 Hill ..... 297/115
4,655,501 A * 4/1987 Ishigami et al. ..... 297/113
5,169,257 A * 12/1992 Liou ..... 403/95
5,489,143 A * 2/1996 Adachi et al. ..... 297/411.38
5,899,533 A * 5/1999 Tatematsu et al. ..... 297/367 R
6,488,134 B2 * 12/2002 Becker et al. ..... 192/19
2003/0189372 A1 * 10/2003 Shephard ..... 297/366
2009/0288270 A1 * 11/2009 Yamashita ..... 16/239
2010/0293748 A1 * 11/2010 Yamashita ..... 16/249

* cited by examiner

*Primary Examiner* — Chuck Y. Mah
(74) *Attorney, Agent, or Firm* — Maxey Law Offices, PLLC; Stephen Lewellyn

(57) ABSTRACT

A triple-tooth weld-on hinge includes a cradle plate, connector spinal plate, crowfoot wrench, riveting pin, connector plate, and spring. The cradle plate, connector spinal plate, and crowfoot wrench are connected through the connector plate and secured with the riveting pin. The bottom is joined by the spring. The range of movement between the cradle plate and the connector spinal plate is between σ1-σ2, or between 105° and 125°. The hinge can be used for securing furniture, particularly steel-framed sofas, as it allows for three angled adjustments between the seats and backs of the sofas. With the various insertion slots on the spinal plate, riveting piece, and cradle plate, the steel-framed sofas can be adjusted to different dimensions.

4 Claims, 4 Drawing Sheets

TRIPLE-TOOTH WELD-ON HINGE

CROSS-REFERENCE TO RELATED APPLICATIONS

This application claims the benefit of the Foreign Patent Application No. CN201020241902.1, filed Jun. 30, 2010.

FIELD OF THE INVENTION

The invention relates to the field of hinges and, more specifically, to hinges that allow for the adjustment of the angle between the seat and back of a steel-framed sofa.

BACKGROUND OF THE INVENTION

Although existing sofas are rather advanced in their specifications and styles, most sofas, even high-end ones, possess only fixed seatbacks that do not allow for angle adjustment.

SUMMARY OF THE INVENTION

The invention is a triple-tooth hinge that allows for sofa seatback adjustment comprising a cradle plate, connector spinal plate, crowfoot wrench, riveting pin, connector plate, and spring. The cradle plate, connector spinal plate, and crowfoot wrench are connected through the connector plate and secured with the riveting pin. The bottom is joined by the spring.

The range of movement between the cradle plate and the connector spinal plate is approximately 105°-125°.

The hinge can be used for securing furniture, particularly steel-framed sofas, as it allows for three angle adjustments between the seats and backs of the sofas. With the various insertion slots on the spinal plate, riveting piece, and cradle plate, the steel-framed sofas can be adjusted to different dimensions.

FIGURES

The detailed description is described with reference to the following set of drawings. The same reference numerals provided on different drawings indicate the same or similar items. Other advantages and aspects of the invention will become apparent upon reading the following description of the drawings and detailed description.

Figure 9:
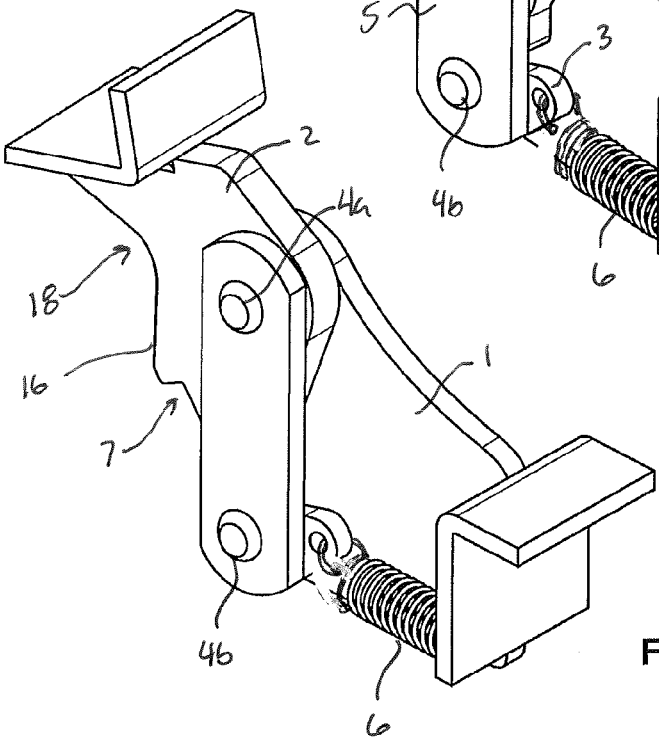

FIG. 9 displays a side view of the hinge in the second position according to another example embodiment of the invention.

DETAILED DESCRIPTION OF THE INVENTION

The triple-tooth weld-on hinge comprises a cradle plate 1, connector spinal plate 2, crowfoot wrench 3, riveting pin 4, connector plate 5, and spring 6. The cradle plate 1, connector spinal plate 2, and crowfoot wrench 3 are connected through the connector plate 5 and secured with the riveting pin 4. The bottom is joined by the spring 6.

More specifically, the cradle plate 1 includes vertically spaced cradle plate apertures 10 and 12 that extend through the cradle plate. The connector spinal plate 2 includes a connector spinal plate aperture 14 that extends through the connector spinal plate and a peripheral edge 16 that defines a plurality of teeth 7 and a recess 18. The connector plate 5 includes vertically spaced connector plate apertures 20 and 22 that extend through the connector plate. The crowfoot wrench 3 includes a crowfoot aperture 24 that extends through the crowfoot wrench.

The connector spinal plate 2 is disposed between the cradle plate 1 and the connector plate 5 with the connector spinal plate aperture 14, cradle plate aperture 10, and connector plate aperture 20 cooperatively aligned. Rivet pin 4*a* extends through the aligned apertures 10, 14, and 20 and connects the cradle plate 1, connector spinal plate 2, and the connector plate 5 together. Connector spinal plate 2 is pivotal about rivet pin 4*a*.

The crowfoot wrench 3 is disposed between the cradle plate 1 and the connector plate 5 with the crowfoot wrench aperture 24, cradle plate aperture 12, and connector plate aperture 22 cooperatively aligned. Rivet pin 4*b* extends through the aligned apertures 12, 22, and 24 and connects the cradle plate 1, the connector spinal plate 2, and crowfoot wrench 3 together. Crowfoot wrench 3 is pivotal about rivet pin 4*b*. Spring 6 is connected at opposite ends to the crowfoot wrench 3 and the cradle plate 1.

Figure 5:
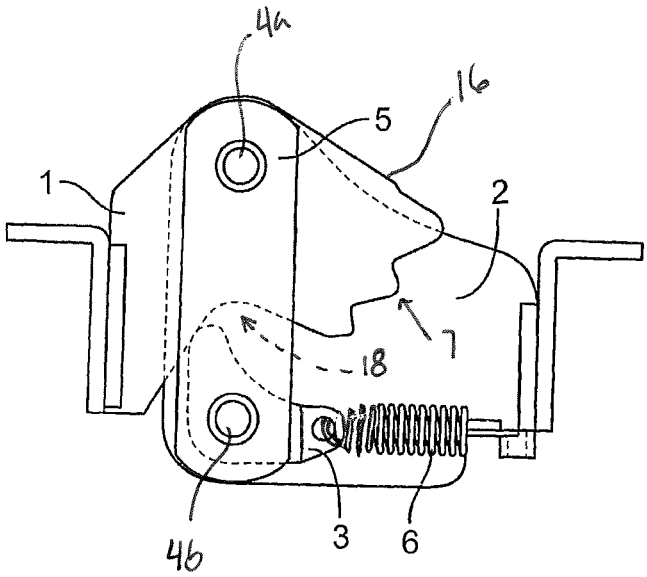
FIG. 5 is a front view of the hinge in a horizontal position according to another example embodiment of the invention.

In FIG. 5, the crowfoot wrench 3 is situated in a free position, and the cradle plate 1 and connector spinal plate 2 are horizontal.

Figure 1:
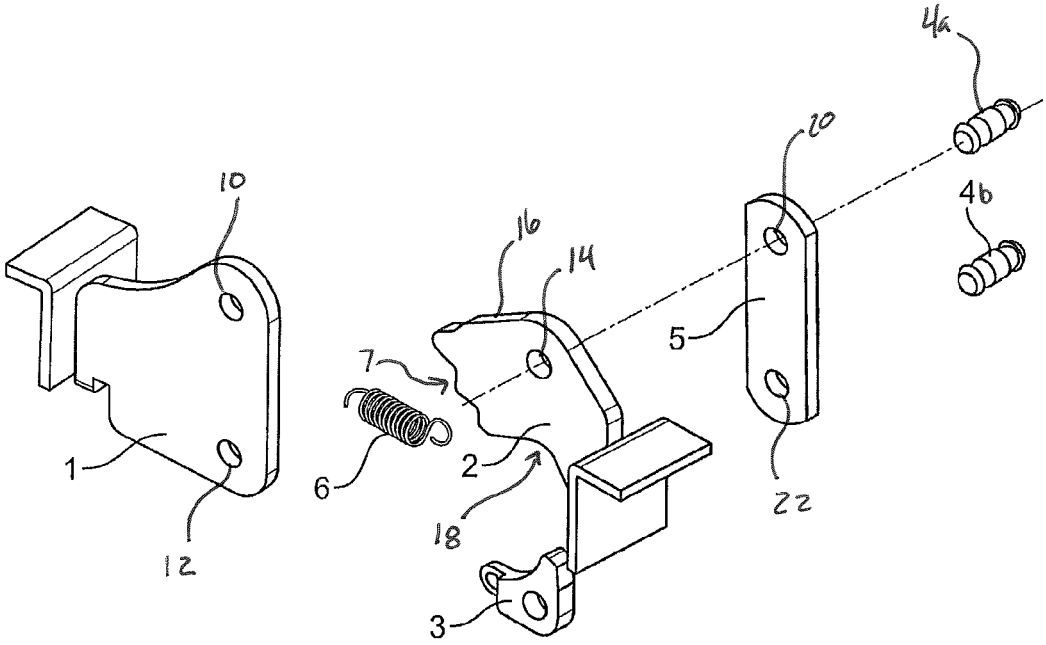
FIG. 1 is a diagram of the triple-tooth hinge according to an example embodiment of the invention.
Figure 2:
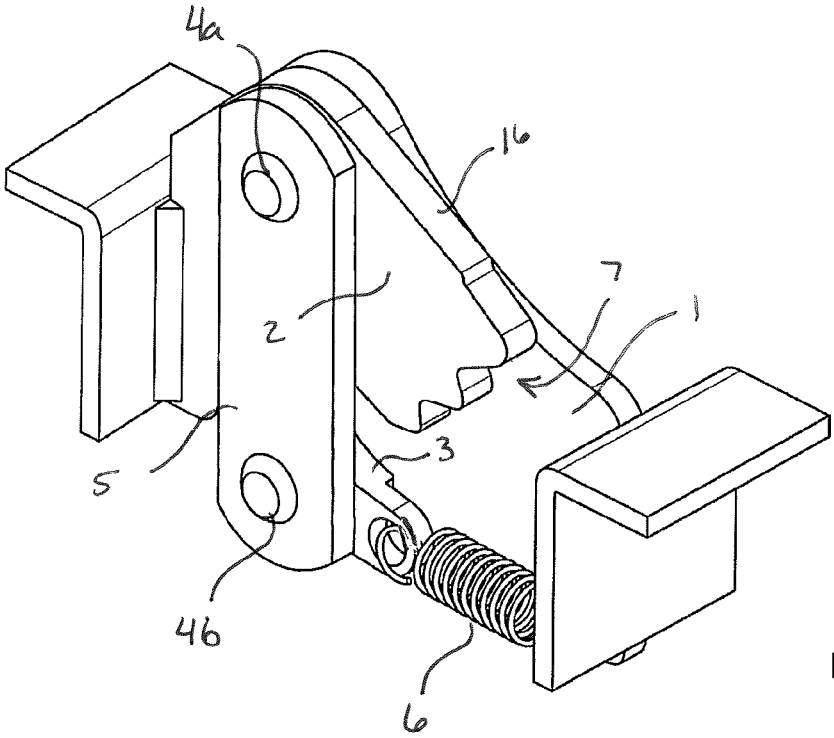
FIG. 2 is a side view of the hinge in a horizontal position according to another example embodiment of the invention.
Figure 3:
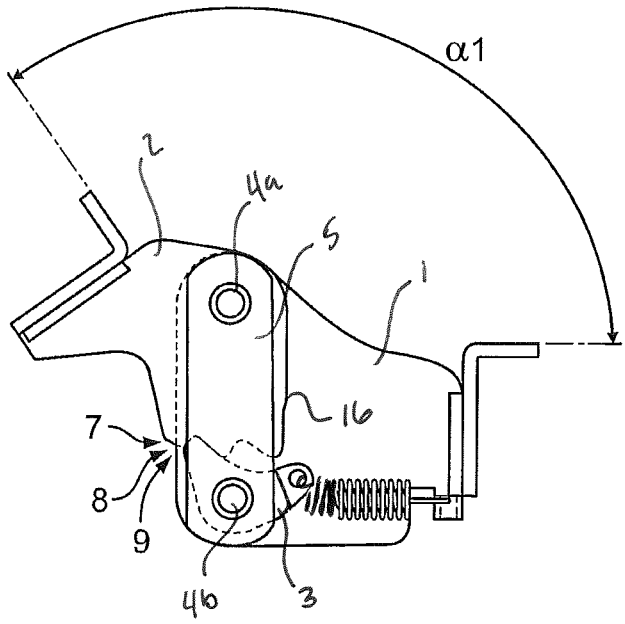
FIG. 3 is a front view of the hinge in a first position according to another example embodiment of the invention.

In FIG. 3, when the connector spinal plate 2 is turned clockwise, the plate's 2 teeth 7 will slip past the top of the crowfoot wrench 3 and lodge into the plate's 2 groove. With the crowfoot wrench's 3 fixing function, the plate 2 cannot move in a counterclockwise direction. Therefore, it is locked into a first position, i.e., position 1, forming a 105° angle σ1.

Figure 4:
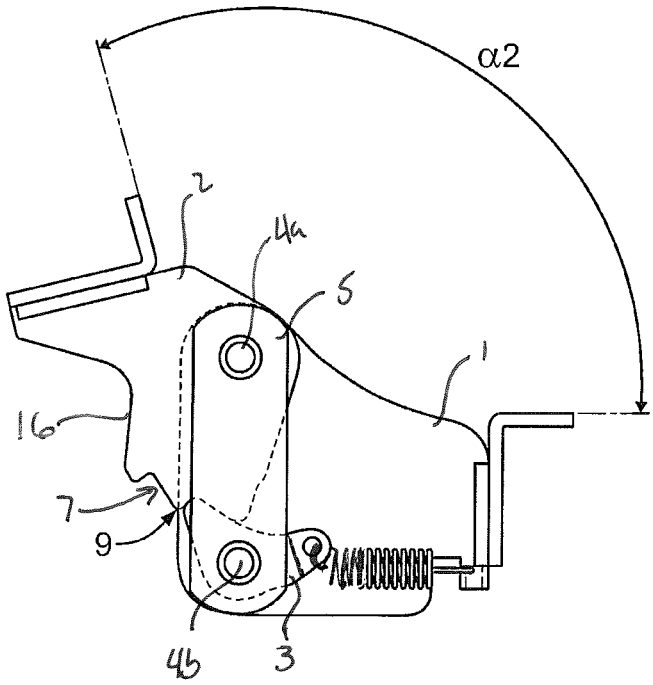
FIG. 4 is a front view of the hinge in a second position according to another example embodiment of the invention.

In FIG. 4, when the connector spinal plate 2 is turned clockwise, the plate's 2 teeth 7 will slip past the top of the crowfoot wrench 3 and lodge into the plate's 2 groove. With the crowfoot wrench 3 at the top 8 and fixing function at the critical point 9, the plate 2 cannot move in a counterclockwise direction. Therefore, it is locked into a second position, i.e., position 2, forming a 125° angle σ2.

Figure 6:
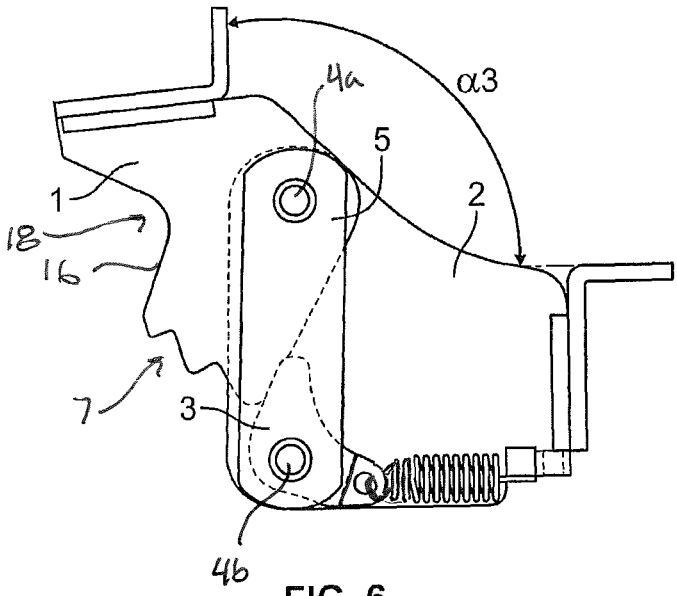
FIG. 6 is a front view of the hinge in an initial position according to another example embodiment of the invention.
Figure 7:
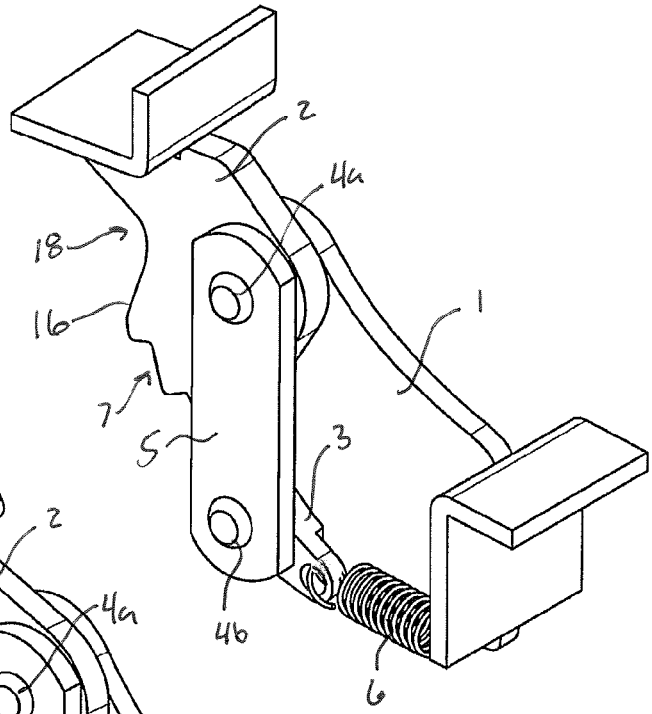
FIG. 7 is a side view of the hinge in an initial position according to another example embodiment of the invention.
Figure 8:
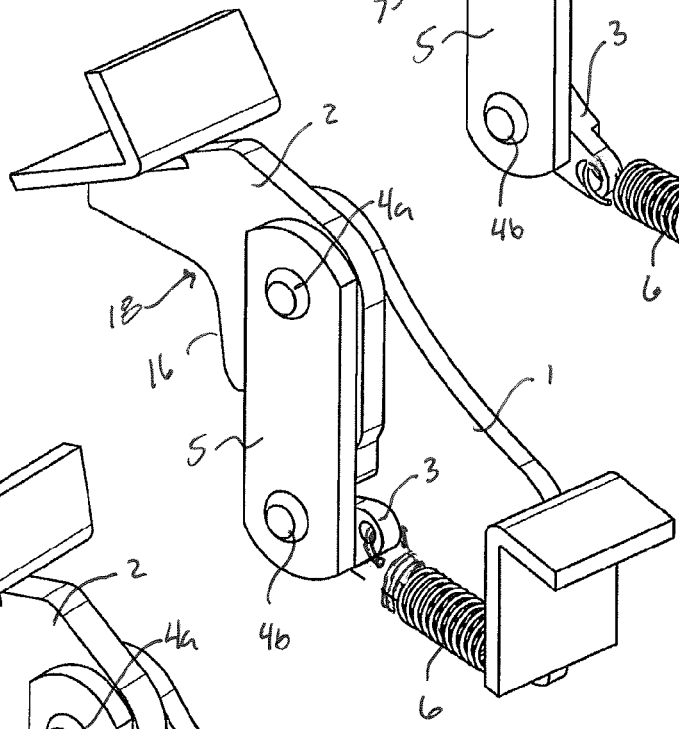
FIG. 8 is a side view of the hinge in the first position according to another example embodiment of the invention.

In FIG. 6, when the connector spinal plate 2 is turned clockwise, the plate's 2 teeth 7 will slip past the top of the crowfoot wrench 3; and, in the absence of grooves, the crowfoot wrench 3 will no longer be fixed, allowing the plate 2 to turn counterclockwise, forming a 90° angle σ3.

The connector spinal plate 2 is manufactured from, for example, Mn16 steel plates, and the crowfoot wrench can be manufactured from, for example, agate steel. The steel of each part may be manufactured through a quenching process.

This application claims priority to Chinese patent no. 2010 2 0241902.1 filed in China on Jun. 30, 2010 which is hereby incorporated by reference in its entirety.

While this invention is susceptible of embodiment in many different forms, there are shown in the drawings and will herein be described in detail, examples of the invention with the understanding that the present disclosure is to be considered as an exemplification of the principles of the invention and is not intended to limit the broad aspect of the invention to the examples illustrated.

I claim:

1. A hinge comprising:

a cradle plate having first and second vertically spaced cradle plate apertures;

a connector plate having first and second vertically spaced connector plate apertures cooperatively aligned with said first and second cradle plate apertures respectively;

a connector spinal plate disposed between said cradle plate and said connector plate, said connector spinal plate having a connector spinal plate aperture cooperatively aligned with said first cradle plate aperture and said first connector plate aperture, said connector spinal plate having a plurality of teeth;

a crow foot wrench disposed between said cradle plate and said connector plate, said crow foot wrench having a crow foot wrench aperture cooperatively aligned with said second cradle plate aperture and said second connector plate aperture;

a first rivet pin extending through said cooperatively aligned said first cradle plate aperture, said first connector plate aperture, and said connector spinal plate aperture, said connector spinal plate pivotal about said first rivet pin;

a second rivet pin extending through said cooperatively aligned second cradle plate aperture, said second connector plate aperture, and said crow foot wrench aperture, said crow foot wrench pivotal about said second rivet pin;

a spring connected at opposite ends thereof to said crow foot wrench and said cradle plate; and said crow foot wrench selectably engageable with one of said plurality of teeth to lock the rotational position of said connector spinal plate relative to said cradle plate.

2. The hinge of claim 1, wherein said plurality of teeth are arranged to selectively lock the rotational position of said connector spinal plate relative to said cradle plate at 105-degrees or 125-degrees.

3. The hinge of claim 1, wherein said plurality of teeth are defined by a peripheral edge of said connector spinal plate.

4. The hinge of claim 1, wherein said connector spinal plate further includes a recess into which said crow foot wrench is non-lockably receivable when said cradle plate and said connector spinal plate are rotated into a free-position.

* * * * *